US007451580B2

(12) United States Patent
Kelly et al.

(10) Patent No.: US 7,451,580 B2
(45) Date of Patent: Nov. 18, 2008

(54) REBAR CHAIR AND SUPPORTING PLATE

(75) Inventors: David L. Kelly, Sacramento, CA (US); Stephen L. Miller, Grass Valley, CA (US); Richard L. Miller, Meadow Vista, CA (US)

(73) Assignee: MMI Management Services LP, Houston, TX (US)

( * ) Notice: Subject to any disclaimer, the term of this patent is extended or adjusted under 35 U.S.C. 154(b) by 633 days.

(21) Appl. No.: 10/810,219

(22) Filed: Mar. 26, 2004

(65) Prior Publication Data

US 2005/0210816 A1 Sep. 29, 2005

(51) Int. Cl.
*E04C 5/16* (2006.01)

(52) U.S. Cl. ..... 52/687; 52/637; 52/649.1; D25/199; D8/354

(58) Field of Classification Search ..... 52/677, 52/687, 689, 682, 683, 633, 637, 646, 649.8, 52/649.1, 698, 697; 248/676, 346.03, 346.3, 248/370, 440.1, 346.04, 163.1; D8/354, D8/380, 349, 384; D25/199; 404/136
See application file for complete search history.

(56) References Cited

U.S. PATENT DOCUMENTS

| | | | | |
|---|---|---|---|---|
| 1,672,852 | A | 6/1928 | Roughan | |
| 1,809,870 | A | 6/1931 | Smith | |
| 1,936,536 | A | 11/1933 | Bates | 72/57 |
| 3,693,310 | A * | 9/1972 | Middleton | 52/685 |
| 3,830,032 | A * | 8/1974 | Robb | 52/687 |
| 4,060,954 | A | 12/1977 | Liuzza | 52/677 |
| 4,080,770 | A | 3/1978 | Vigh | 52/689 |
| 4,483,119 | A | 11/1984 | Hernandez | 52/689 |

(Continued)

FOREIGN PATENT DOCUMENTS

| | | |
|---|---|---|
| AU | 227969 | 5/1960 |
| FR | 2549870 | 7/1983 |
| GB | 575043 | 1/1946 |
| WO | WO 90/01600 * | 2/1990 |

OTHER PUBLICATIONS

AZTEC Promotional Brochure for Plastic Rebar Spacer (1994).

(Continued)

*Primary Examiner*—Richard E. Chilcot, Jr.
*Assistant Examiner*—William V Gilbert
(74) *Attorney, Agent, or Firm*—John K. Uilkema; Thelen LLP

(57) ABSTRACT

A polymeric chair having a rebar cradle and legs of a T-shaped cross-section diverging downwardly from the cradle. The outer surface portions of the legs are arcuate and define segments of a cone. Inwardly extending web portions reinforce the legs and provide feet at the distal ends of the legs disposed to the inside of the outer surface portions. A flat sand plate for the chair has radially extending slots formed therethrough which are proportioned for snug engagement with side surfaces of the feet. The slots are elongate to accommodate different sized chairs having feet spaced at varying radial dimensions. The web portions taper to optimize their reinforcing function and conserve material. In one embodiment, a ring is formed integrally with the legs intermediate the table and the distal ends of the legs. The chair is of a unitary construction and may have an integrally formed strap for extension over the cradle to secure a rebar in place.

38 Claims, 10 Drawing Sheets

U.S. PATENT DOCUMENTS

| | | | | | |
|---|---|---|---|---|---|
| 4,655,023 | A | | 4/1987 | Yung | 52/685 |
| 4,682,461 | A | | 7/1987 | Sizemore | 52/689 |
| 4,756,641 | A | * | 7/1988 | Hartzheim | 404/136 |
| 4,835,933 | A | * | 6/1989 | Yung | 52/685 |
| 5,107,654 | A | * | 4/1992 | Leonardis | 52/685 |
| D334,133 | S | | 3/1993 | Hartzheim | D8/354 |
| 5,555,693 | A | * | 9/1996 | Sorkin | 52/689 |
| D388,312 | S | | 12/1997 | Sorkin | D8/354 |
| 5,729,949 | A | | 3/1998 | Hartzheim | 52/677 |
| D394,200 | S | | 5/1998 | Hartzheim | D8/354 |
| 5,791,095 | A | | 8/1998 | Sorkin | 52/105 |
| D421,709 | S | | 3/2000 | Haslem et al. | D8/354 |
| D428,501 | S | | 7/2000 | Haslem et al. | D25/199 |
| 6,089,522 | A | * | 7/2000 | Haslem et al. | 248/440 |
| D443,197 | S | | 6/2001 | Padrun | D8/354 |
| D444,244 | S | | 6/2001 | McPherson et al. | D25/199 |
| 6,276,108 | B1 | | 8/2001 | Padrun | 52/684 |
| D454,776 | S | | 3/2002 | Padrun | D8/354 |
| 6,354,054 | B1 | | 3/2002 | Verelli et al. | 52/686 |
| 2003/0000170 | A1 | | 1/2003 | Sorkin | 52/677 |

OTHER PUBLICATIONS

Meadow Steel Products Pricing Brochure for Reinforcing Bar Supports (Feb. 1, 1994).

Meadow Steel Products Plastic Accessories Catalog (1991).

* cited by examiner

REBAR CHAIR AND SUPPORTING PLATE

The present invention relates to a chair for supporting rebars in spaced relationship above a surface over which poured concrete is formed. It is particularly concerned with a unitary chair fabricated of polymeric material wherein the legs of the chair present smooth outer surfaces and are internally formed with reinforcing webs which terminate in distal feet. In its more specific aspects, the invention is concerned with such a chair which may be injection molded and is of a very strong and stable construction. The invention also provides a bearing plate to support the chair against tipping or penetration relative to a soft earthen bed upon which the chair is supported.

The rebar chair of the invention may also be referred to as a pedestal. While the invention is described with reference to rebar, it may also be used to support other internal reinforcements for poured concrete, such as post tensioned cables or welded wire mesh.

BACKGROUND OF THE INVENTION

Chairs or pedestals for supporting rebar in spaced relationship to a surface over which poured concrete is formed are well known in the prior art. Some comprise no more than small concrete blocks provided with wire to secure the blocks to the rebar. Others are fabricated of bent wire. More recently, a number have been made of polymeric material. The devices of U.S. Pat. Nos. 4,682,461; 4,756,641; and 5,555,693 are typical of the later type.

While polymeric chairs have the advantage that they are relatively inexpensive and do not corrode, they have been problematic insofar as their strength and stability is concerned. Also, they have met with resistance in the trade because of the difficulty of securing the chairs to the rebar being supported. The later problem has been exacerbated by the provision of internal structure between the legs of the chairs, which structure has restricted free access between the legs. Such restricted access makes it difficult to extend ties through the chairs and also impedes stackability of the chairs during storage and transport.

Another problem with prior art polymeric chairs is that their relatively complicated construction has made it difficult and expensive to manufacture the chairs by injection molding.

SUMMARY OF THE INVENTION

The principal elements of the chair of the present invention comprise a cradle for supporting engagement with a rebar and legs fixed to and extending downwardly from the cradle at annularly spaced locations. The legs diverge outwardly from the cradle and are formed with arcuate outer surface portions which define a smooth interrupted cone. Web portions extend inwardly of the outer portions over the length of the legs and terminate in distal ends which provide feet to the interior of the outer portions. The feet are formed with irregular bottom surfaces to enhance traction. The cradle is provided by a table having diametrically opposed ears extending upwardly therefrom; which ears may be located so as to be intermediate the legs, or in alignment with the legs.

In one embodiment, a ring is integrally formed with and extends between the legs to reinforce the legs against spreading. The ring is located at a level between the cradle and the distal ends of the legs and is of an arcuate configuration which merges with the outer portions of the legs to continue the interrupted conical surface defined by the legs.

Another embodiment has a strap integrally formed with the chair for select extension over the cradle to secure a rebar within the cradle.

DESCRIPTION OF THE PREFERRED EMBODIMENTS

Figure 1:
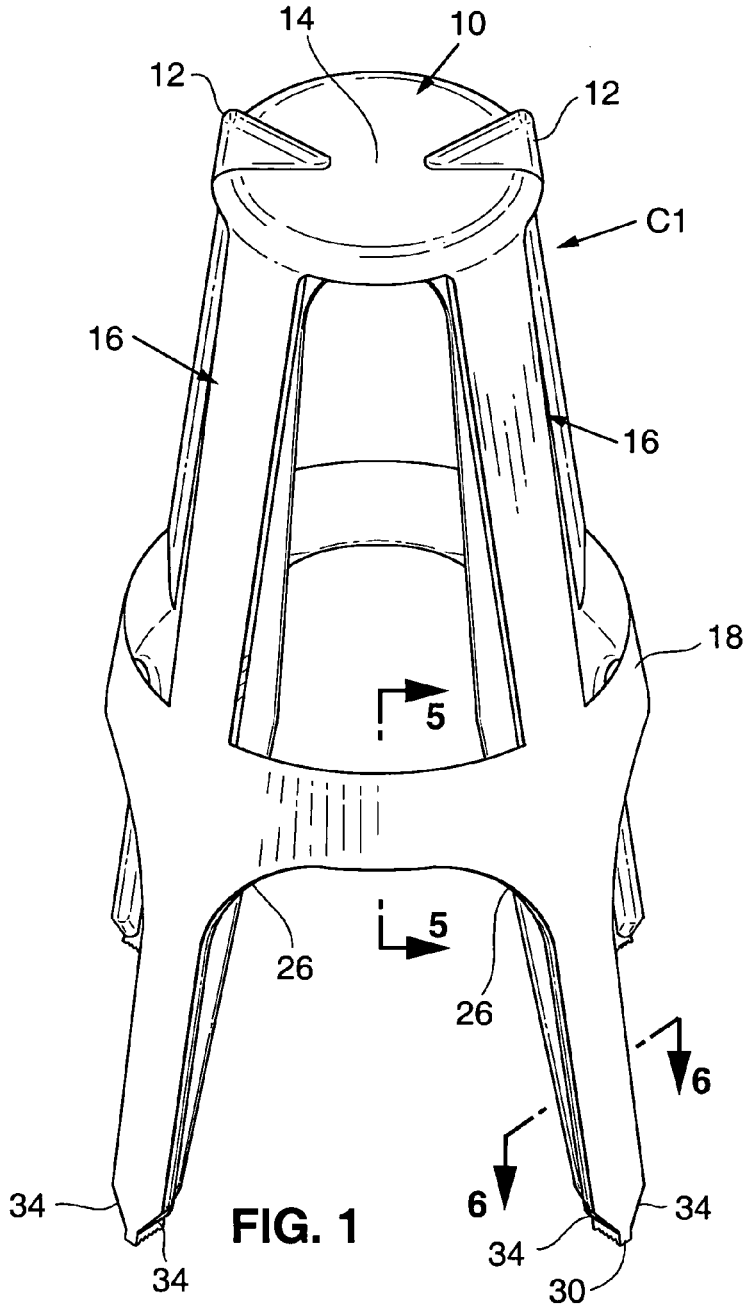
FIG. 1 is a perspective view of a first embodiment of the inventive chair wherein a ring is formed integrally with the legs.
Figure 5:
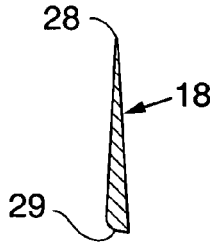
FIGS. 5 and 6 are cross-sectional views taken on the planes designated by lines 5-5 and 6-6, respectively, of FIG. 1.
Figure 6:
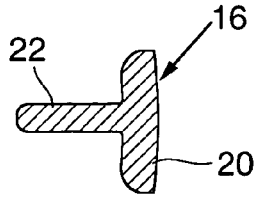

All embodiments of the inventive chair are injection molded from polymeric material. A preferred material has been found to be a derivative of recycled polypropylene known as "PRE-TUF" by PrePlastics of Auburn, Calif. Other suitable materials are polycarbonate/ABS alloy, polypropylene, polyethylene, polystyrene, glass filled polystyrene, glass filled nylon, and polyvinyl chloride.

The dimensions of the chair may vary, depending on the thickness of the concrete slab being formed. Typical chair heights range from one and one-quarter inch to ten inches, in one-quarter inch increments. The angle at which the legs diverge from the supporting table of the chair is chosen for optimum strength and stability, with the preferred range being 94° to 104°.

First Embodiment Chair

The chair of this embodiment is shown in FIGS. 1 to 6 and designated in its entirety by the letter C1. It comprises a horizontal table 10 of a generally circular configuration having ears 12 extending upwardly from diametrically opposite sides thereof to define a rebar receiving cradle 14; legs 16 integrally formed with the table 10 and diverging downwardly and outwardly therefrom; and a ring 18 formed integrally with the legs 16 at a location intermediate the table 10 and distal ends of the legs 16. As shown, four legs 16 are provided and extend downwardly from the table 10 at equally spaced annular locations around the table. The ears are located so as to be between the legs, thus providing a stable arrangement where two legs are disposed to either side of a rebar received in the cradle between the ears.

As viewed in cross-section (see FIG. 6), the legs are of a generally T-shaped cross-section and each comprise an outer surface portion 20 and an inwardly extending reinforcing web portion 22. The outer surface portions define as interrupted frusto conical cone diverging downwardly from the table 10. The web portions 22 taper from either end of the legs so as to have an increased depth portion approximately mid-length of the legs (see FIG. 2). The later construction provides a truss-like reinforcement for the legs which renders them very rigid. From FIG. 2 it will also be seen that the web portions of oppositely disposed legs include a central portion 24 integrally formed with and extending beneath the table 10. The merger between the reinforcing web portions 22 and central portion 24 has a relatively large radius, thus adding to the overall rigidity of the chair. The central portions 24 meet at the center of the table 10 (see FIG. 4) to add even more to this rigidity.

The ring 18 merges with the outer surface portions 20 of the legs so as to form a smooth outer surface continuing the interrupted conical configuration defined by the outer surface portions. At the lower edge of the merger between the ring 18 and the outer surface portions 16, the ring is arched so as to provide radius portions 26 which increase the area of merger between the ring and the legs and serve to expand the reinforcement to the legs provided by the ring. As viewed in cross-section, the ring 18 tapers in thickness from its upper edge 28 to its lower edge 29 (see FIG. 5). This configuration ideally suits the chair for injection molding with a core of simple construction which may be readily removed.

Figure 2:
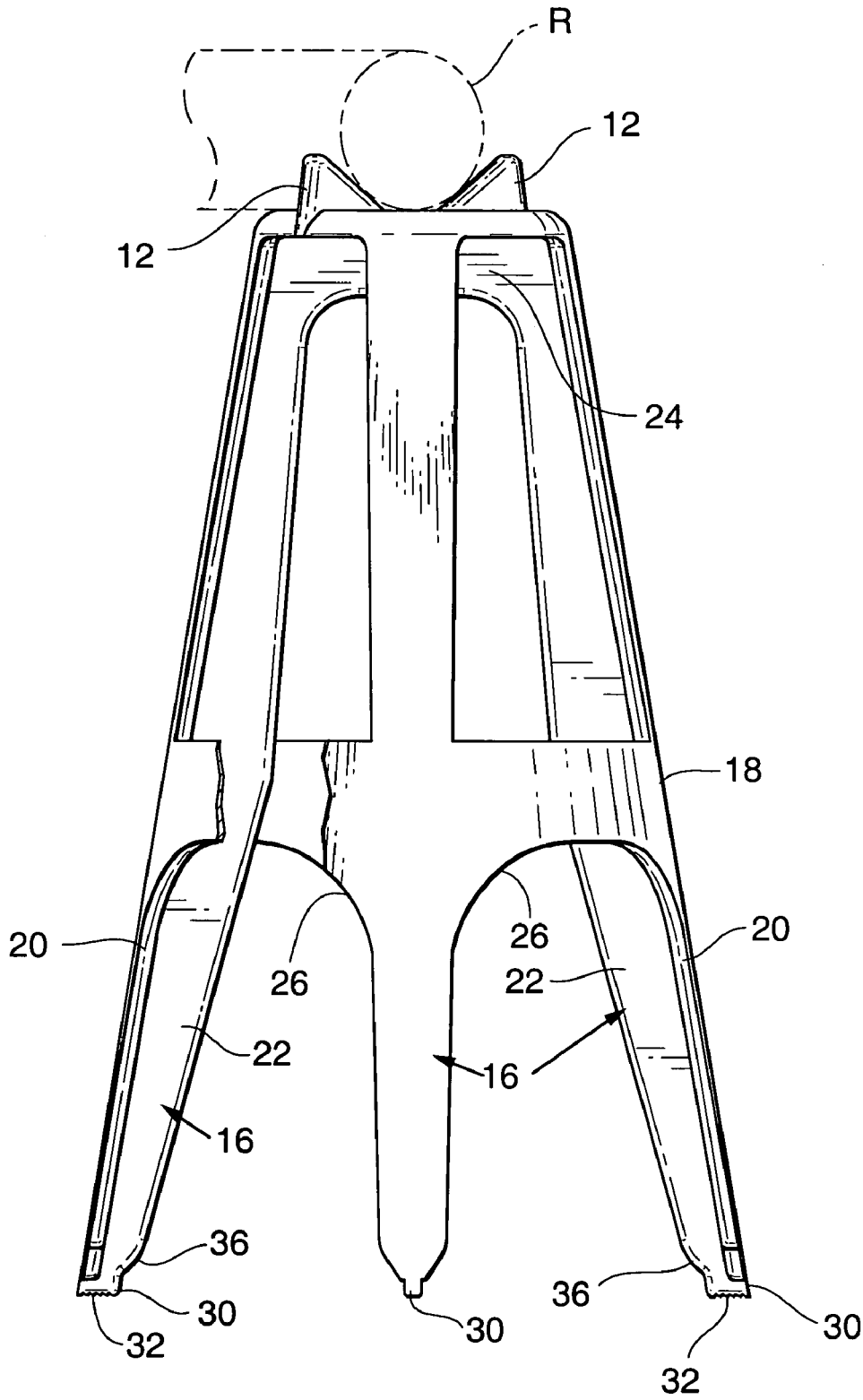
FIG. 2 is a elevational view of the first embodiment chair, with a part thereof broken away to show the internal construction of the chair.
Figure 3:
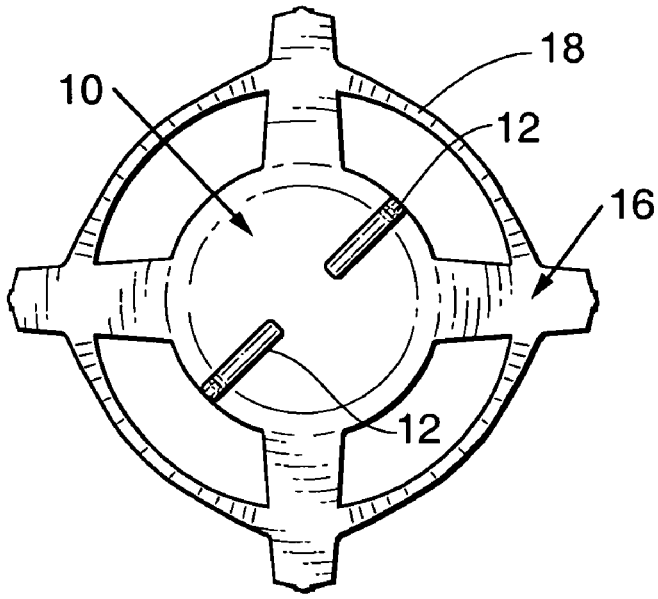
FIG. 3 is a plan view of the first embodiment chair.
Figure 4:
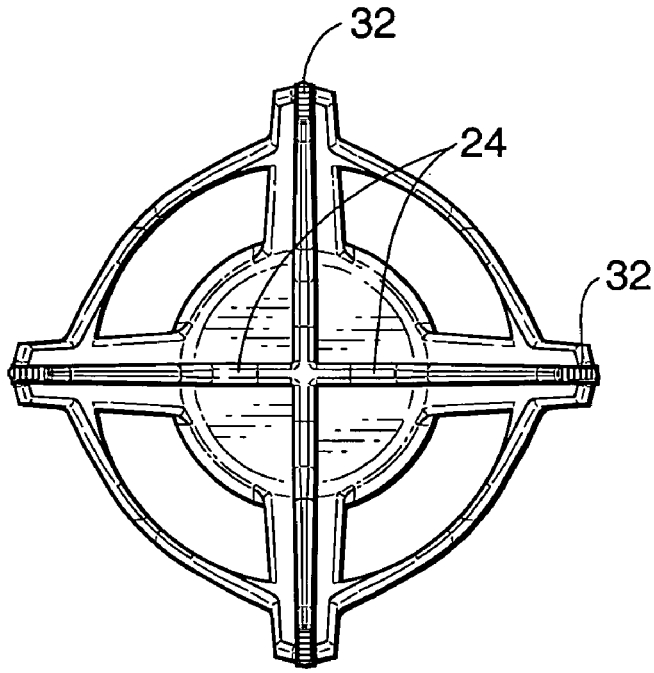
FIG. 4 is a bottom view of the first embodiment chair.
Figure 7:
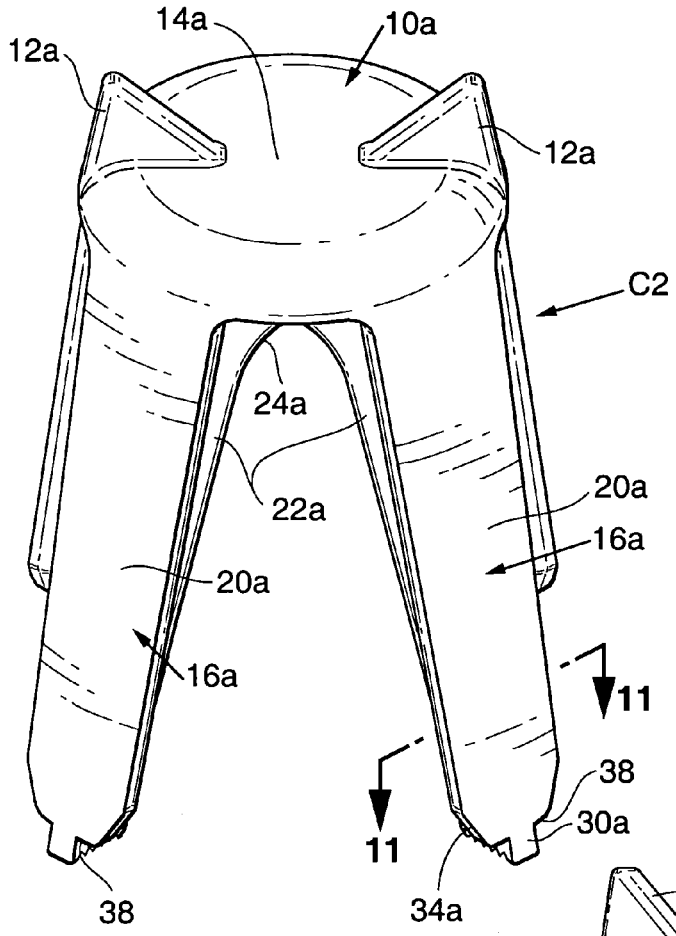
FIG. 7 is a perspective view of a second embodiment of the inventive chair, wherein no ring is provided between the legs of the chair.

The distal ends of the legs 16 are formed by extensions 30 of the web portions 22 (see FIG. 2). These extensions are disposed inwardly on the outer surfaces of the portions 20 and provide a foot including, traction means in the form of serrations 32, formed on the under-surface of the extensions. The serrations 32, as may be seen from FIG. 4, extend transversely of the web portions 22. The outer surface portions 20 converge towards the extensions 30 through inclined surfaces 34 proximal to the distal ends of the legs. These inclined surfaces provide space proximal to the distal ends of the legs 16 into which fluid concrete formed around the legs may flow, thus avoiding the creation of voids in the concrete. Such voids are also avoided through the use of rounded radiuses 36 at the merger of the web portions 22 and the extensions 32.

The cradle defined between the ears 12 extends transversely across the table 10 so that a rebar R (see FIG. 2) supported on the table is disposed between the legs 16. As the result of this arrangement, with a four-legged chair, two legs are disposed symmetrically to either side of the rebar.

Second Embodiment Chair

This embodiment is shown in FIGS. 7 to 11 and designated, in its entirety, by the reference C2. It differs from the first embodiment primarily in that it is not provided with a ring, such as the ring 18, and in that the web portions converge uniformly towards the distal ends of the legs. Parts of the second embodiment corresponding to those of the first embodiment are designated by like numerals, followed by the reference "a", as follows:

Table 10*a*
Ears 12*a*
Cradle 14*a*
Legs 16*a*
Outer surface portions 20*a*
Reinforcing web portions 22*a*
Central portion 24*a*
Extensions 30*a*
Serrations 32*a*
Inclined surfaces 34*a*

Figure 8:
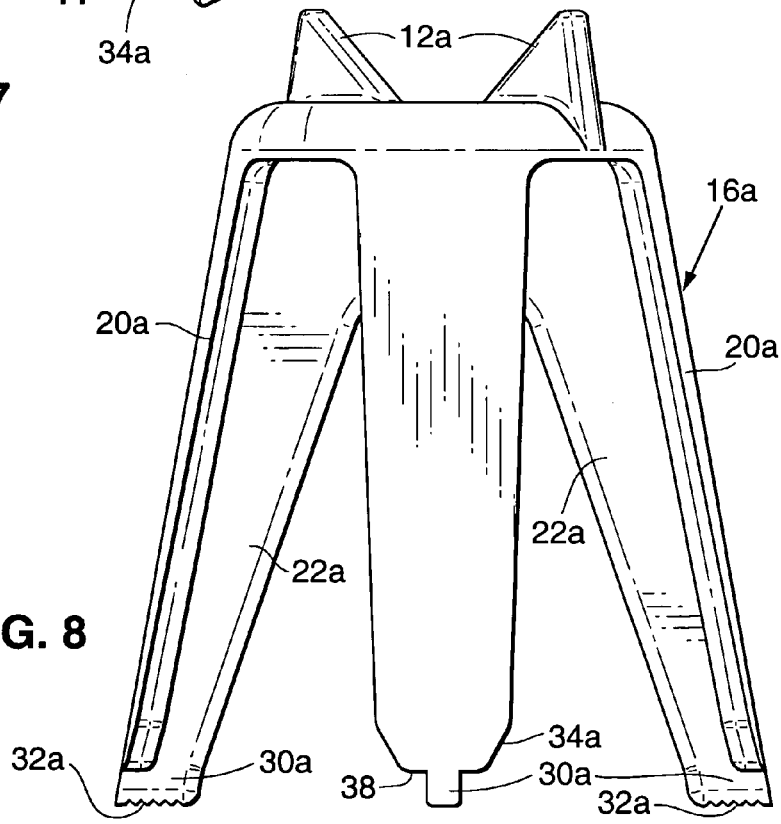
FIG. 8 is an elevational view of the second embodiment chair.
Figure 9:
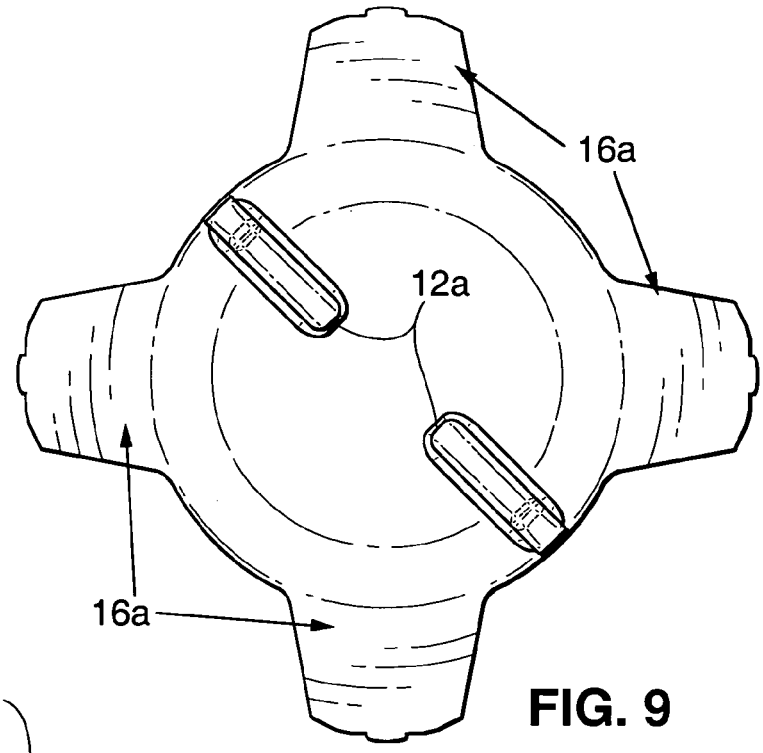
FIG. 9 is a plan view of the second embodiment chair.
Figure 10:
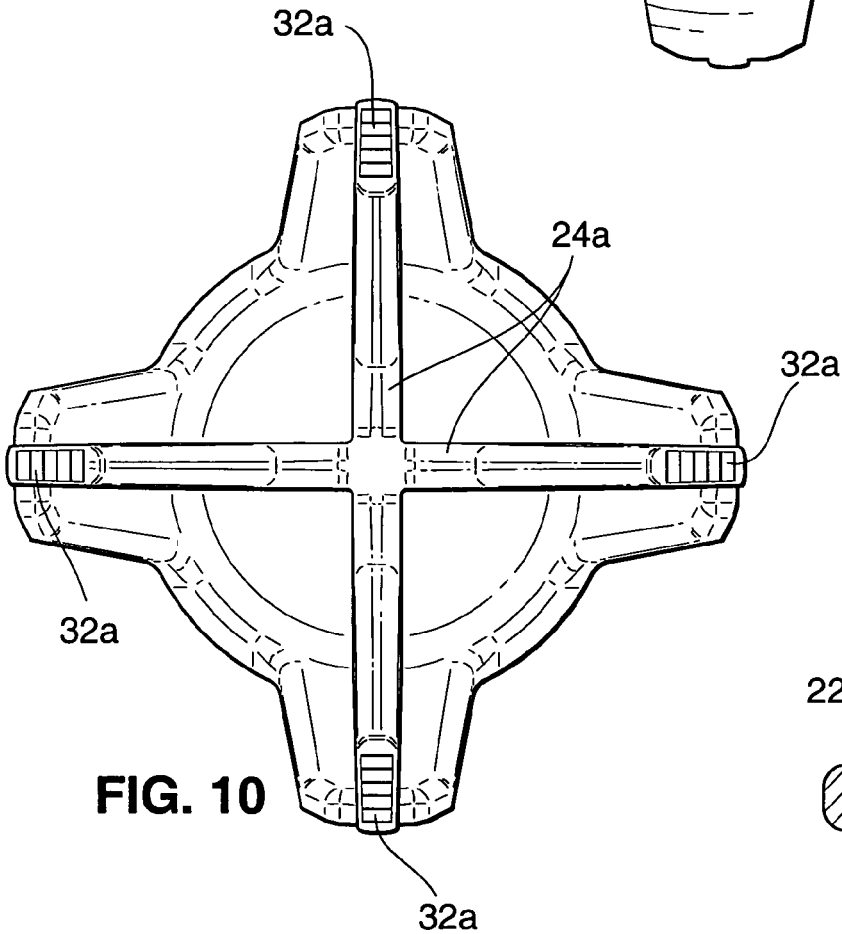
FIG. 10 is a bottom view of the second embodiment chair.
Figure 11:
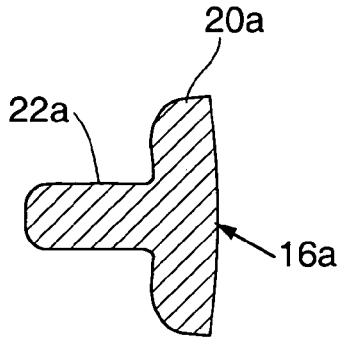
FIG. 11 is a cross-sectional view taken on the plane designated by line 11-11 of FIG. 7.
Figure 12:
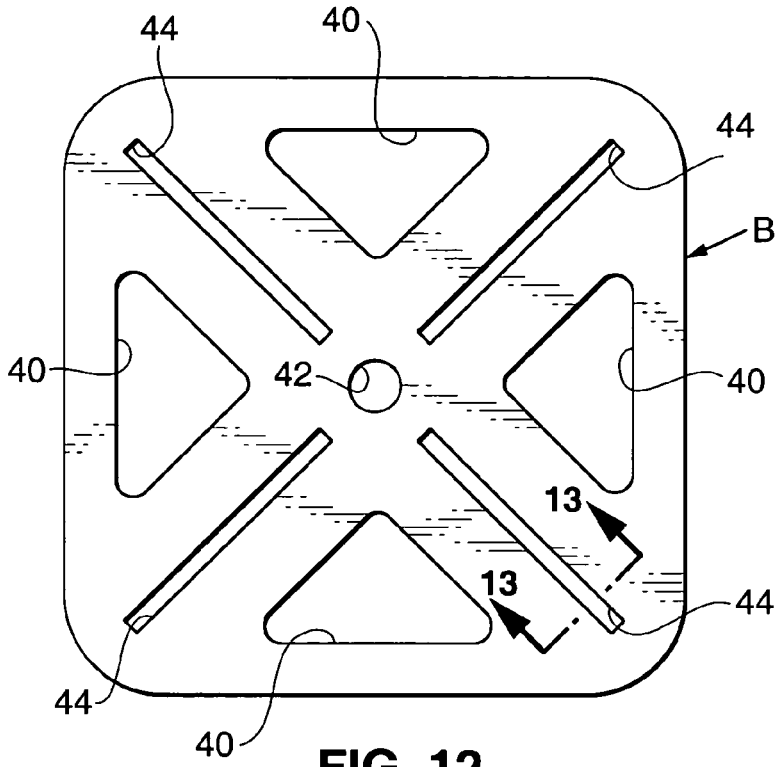
FIG. 12 is a plan view of the bearing plate of the present invention.
Figure 13:
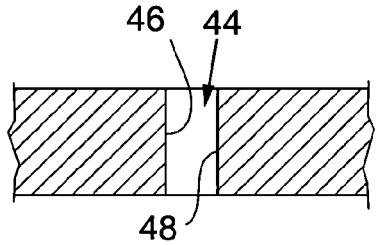
FIG. 13 is a cross-sectional view of the bearing plate, taken on the plane designated by line 13-13 of FIG. 12.
Figure 14:
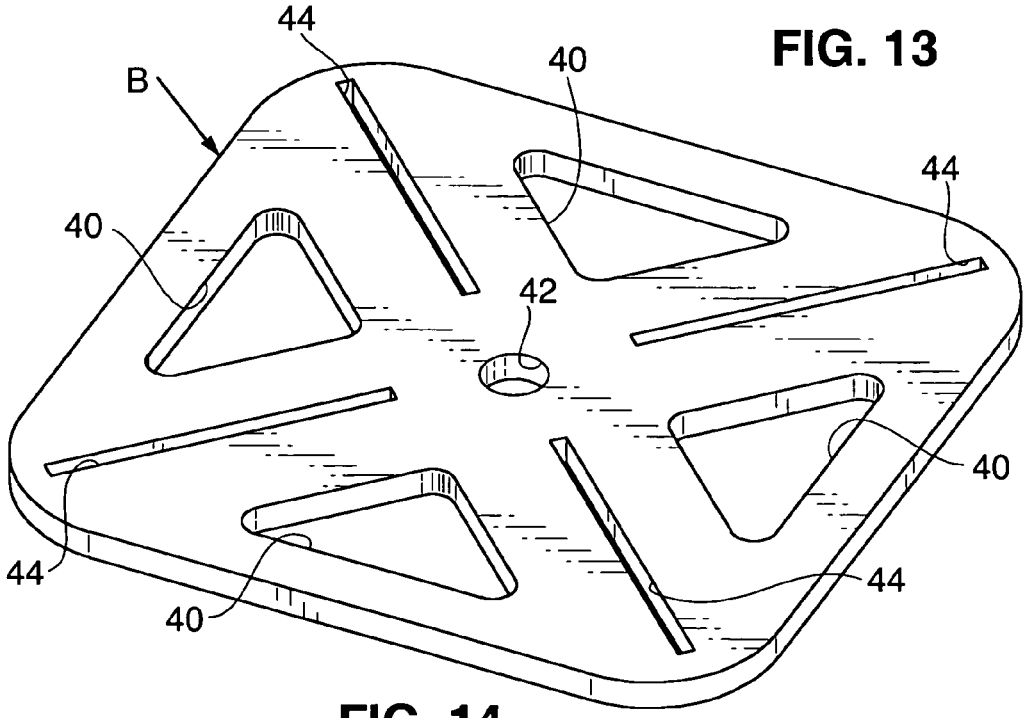
FIG. 14 is a perspective view of the FIG. 12 bearing plate.

As may be seen from FIG. 8, the web portions 22*a* converge uniformly in a generally straight line from the central portion 24*a* to the extensions 30*a*. Another difference between the first and second embodiments is that in the second embodiment a shoulder 38 is formed between the inclined surfaces 34*a* and the extensions 30*a*.

The second embodiment operates in the same manner as the first embodiment in that the cradle 14*a* extends transversely of the table 10*a* between a pair of legs 20*a* to either side thereof.

While the first and second embodiments function in the same way, the first embodiment is especially designed for relatively high chairs where the legs 16 are quite long and the added reinforcement provided by the ring 18 and the truss-like reinforcing of portions 22 greatly enhances the rigidity of the chair structure. The second embodiment is a simplified construction ideally suited for use in relatively short chairs.

Bearing Plate

The bearing plate shown in FIGS. 12 to 16 is designated in its entirety by the reference B and is for purposes of supporting the chair of the invention against uneven penetration into soft soil. Such plates are also known in the trade as "sand plates."

In the illustrated embodiment, the body of plate B is fabricated of a polymer material similar to that of the chair. It is designed to universally accommodate chairs of different heights and may be used to support any of the embodiments of the chairs herein disclosed. A typical plate would measure 4½ by 4½ inches and have a thickness of one-quarter inch.

The plate B is formed with generally triangular lightening holes 40 and a central hole 42. These holes are intended primarily to conserve material and lighten the weight of the plate. Diagonally extending slots 44 extend radially relative to the central hole 42 for alignment with and complimental receipt of the extensions 30, 30*a*, and 30*b* of the chairs. These slots have a transverse dimension slightly less than that of the extensions, so that the opposed side surfaces of the slots, designated 46, 48 (see FIG. 13) snuggly receive and frictionally engage opposite sides of the extensions.

Figure 15:
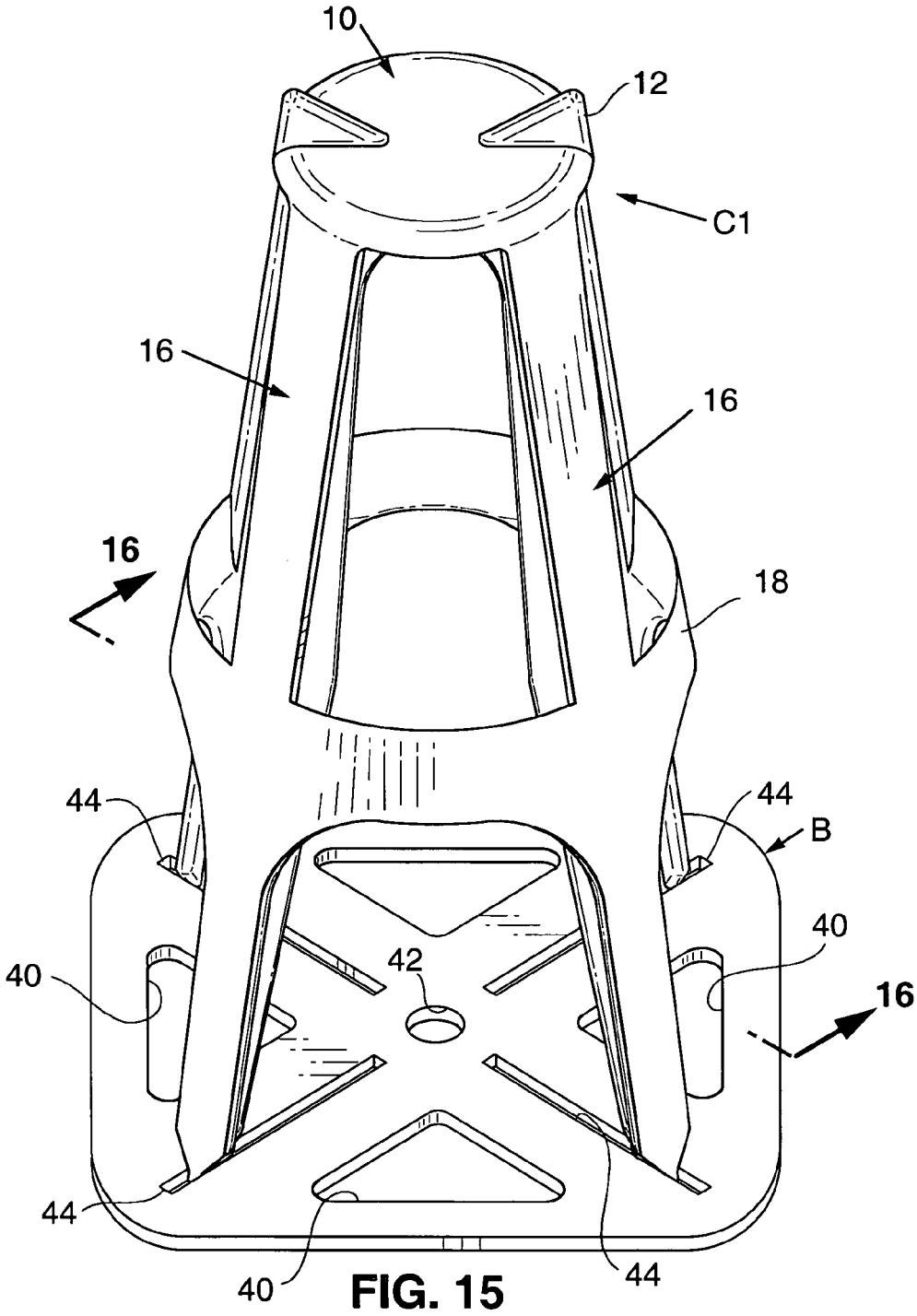
FIG. 15 is a perspective view of the first embodiment chair of FIG. 1, shown supported on the bearing plate of FIG. 12.
Figure 16:
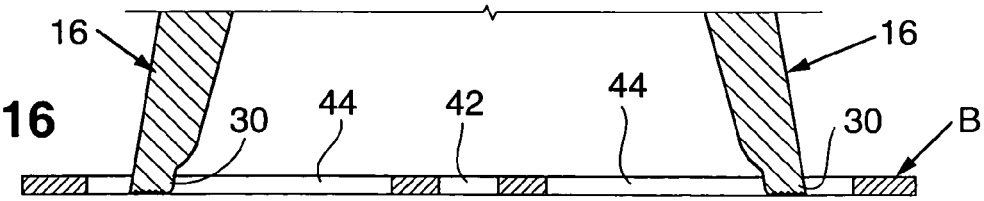
FIG. 16 is a cross-sectional elevational view taken on the plane designated by line 16-16 of FIG. 15.

FIGS. 15 and 16 show the chair C1 of the first embodiment with the extensions 30 thereof snuggly received within the slots 44. As there seen, it will be appreciated that the extensions 30 are disposed intermediate the radially spaced inner and outer extremities of the slots 44. This demonstrates how a particular bearing plate B may accommodate chairs of different sizes. For smaller chairs, the extensions 30, 30*a* would be closer to the center of the plate.

The flat planar top surface of the plate B facilitates the formation of concrete around the assembled plate and chair, without creating voids. This contrasts to prior art plates wherein upperwardly extending structure on the plates may create such voids.

Third Embodiment Chair

Figure 17:
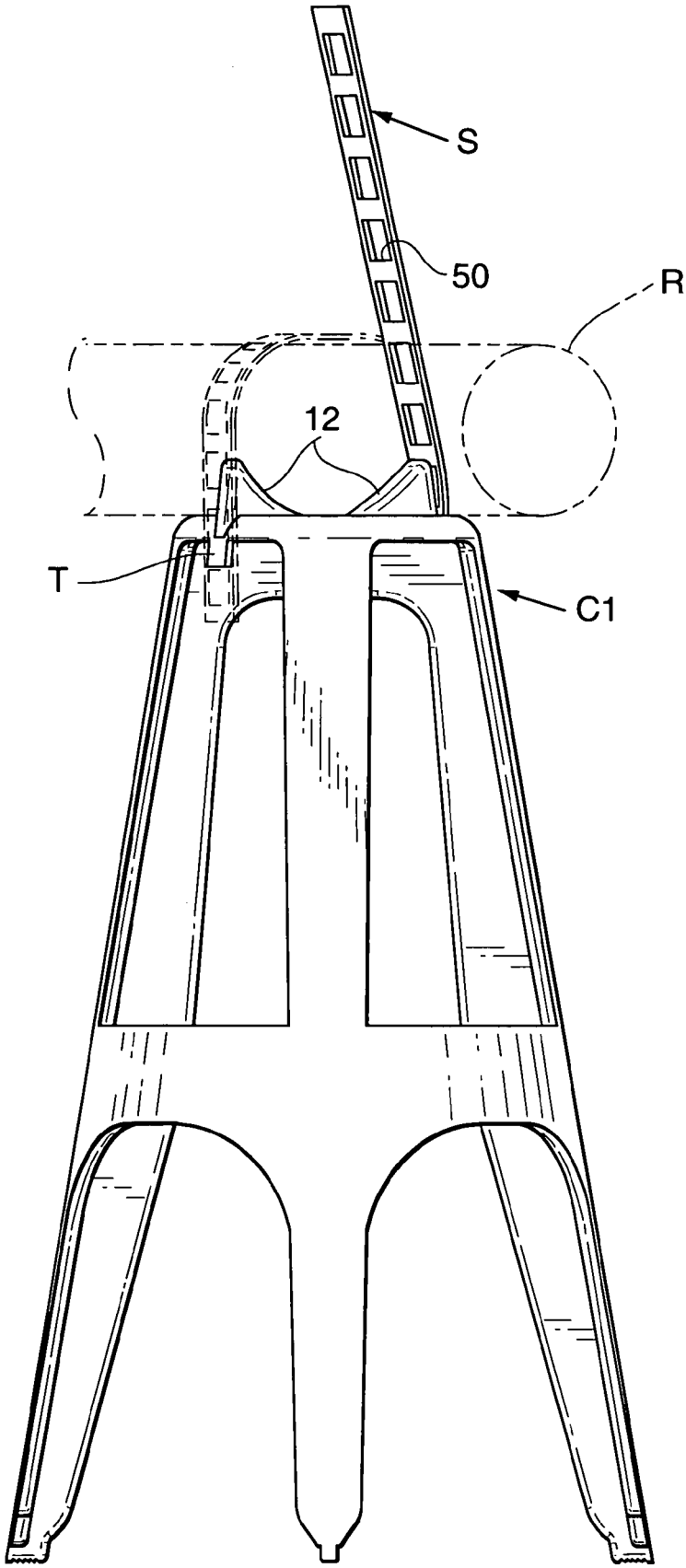
FIG. 17 is an elevational view of a third embodiment of the inventive chair, similar to that of FIGS. 1 to 6, except that it is additionally provided with an integrally formed strap and securing means therefore.

The chair of this embodiment is shown in FIG. 17. It differs from the first embodiment chair in that it is provided with a strap S and retaining tab T therefor. The strap S is integrally formed with the chair C1 to the outside of an in alignment with one of the ears 12. The tab T is integrally formed with the chair C1 in alignment with and extending downwardly from the other of the ears 12. The thickness of the strap S is such that the strap is relatively flexible. Generally rectangular openings 50 are formed through the strap S at spaced intervals for select engagement over the tab T. The phantom line illustration in FIG. 17 illustrates the condition which the strap would assume when engaged over the tab T. As so engaged, the strap would extend over and retain a rebar supported on the cradle of the chair. The alignment of the strap S with the ears 12 assures that such engagement is secure.

Fourth Embodiment Chair

The chair of this embodiment is shown in FIGS. 18 to 22 and is designated, in its entirety, by reference C4. It differs from the second embodiment primarily in that:

1) the table is of a cross-shaped planar configuration;

2) additional reinforcements are provided beneath the table; and 3) the ears are aligned with oppositely disposed legs of the chair. Parts of the fourth embodiment corresponding to those of the second embodiment are designated by like numerals, followed by the reference "b," as follows:

Table 10*b*
Ears 12*b*
Cradle 14*b*
Legs 16*b*
Outer surface portions 20*b*
Reinforcing web portions 22*b*
Central portion 24*b*
Extensions 30*b*
Serrations 32*b*
Inclined surfaces 34*b*
Shoulder 38*b*

Figure 20:
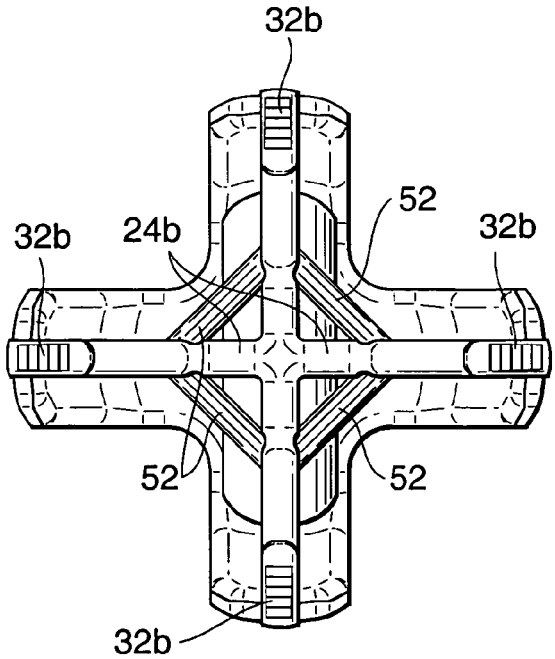
FIG. 20 is a bottom view of the fourth embodiment chair.
Figure 21:
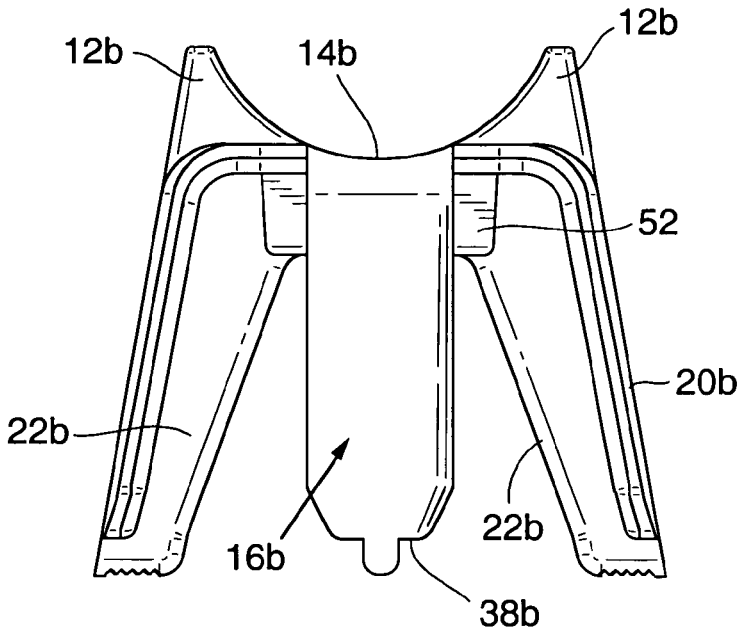
FIG. 21 is an elevational view of the fourth embodiment chair.
Figure 22:
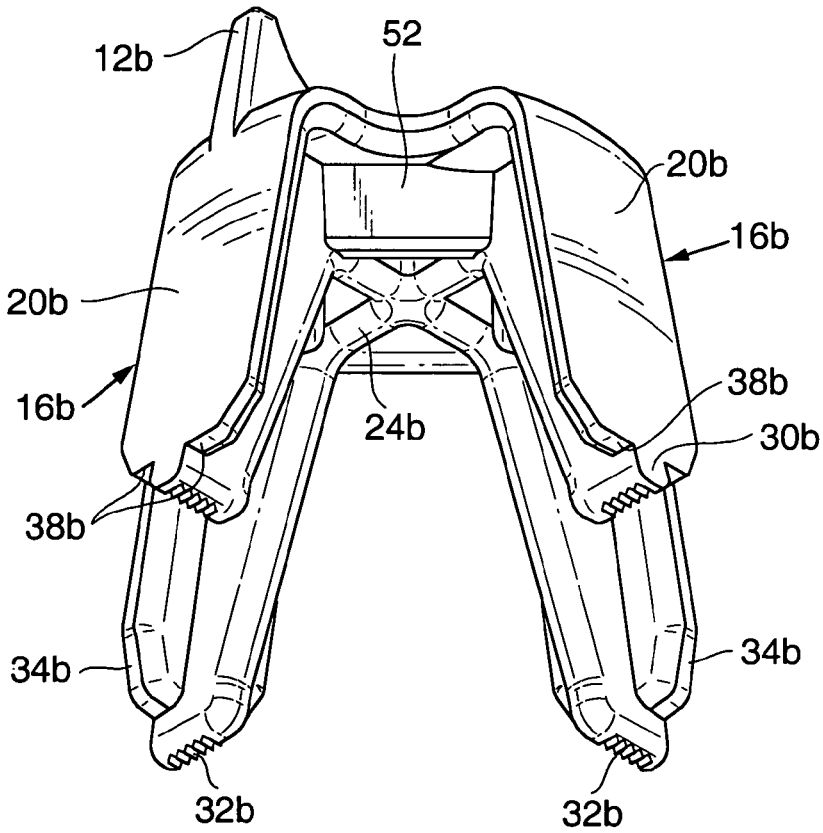
FIG. 22 is a perspective view of the fourth embodiment chair, viewed toward the bottom.

The fourth embodiment also differs from the second embodiment in that it is provided with additional reinforcing webs 52 integrally formed with the table 10*b* and merging with the reinforcing web portions 22*b* (see FIG. 20). The reinforcing webs 52 function to further rigidify the legs 16*b* and to provide additional support for the table 10*b*.

The crossed-shaped configuration of the table 10*b* also differs from that of the tables 10 and 10*a* in that it is not of a planar configuration. Rather, it is of a generally concave configuration at the portion thereof defining the cradle 14*b*. The ears 12*b* are of a concave arcuate configuration which merge with the cradle 14*b*, as may best be seen from FIG. 21.

Figure 18:
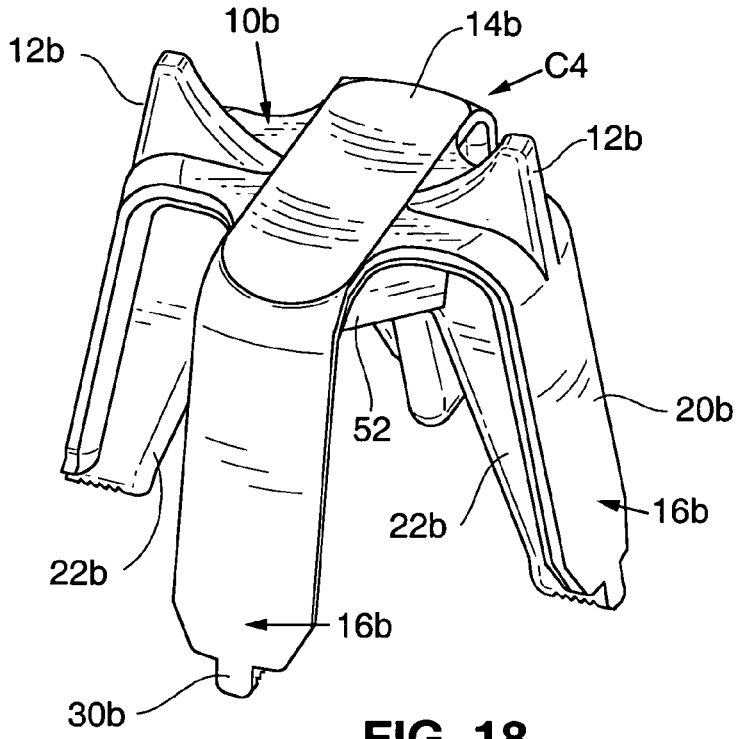
FIG. 18 is a perspective view of a fourth embodiment of the inventive chair, viewed from toward the top, wherein no ring is provided between the legs of the chair and the table of the chair of a generally X-shaped configuration.
Figure 19:
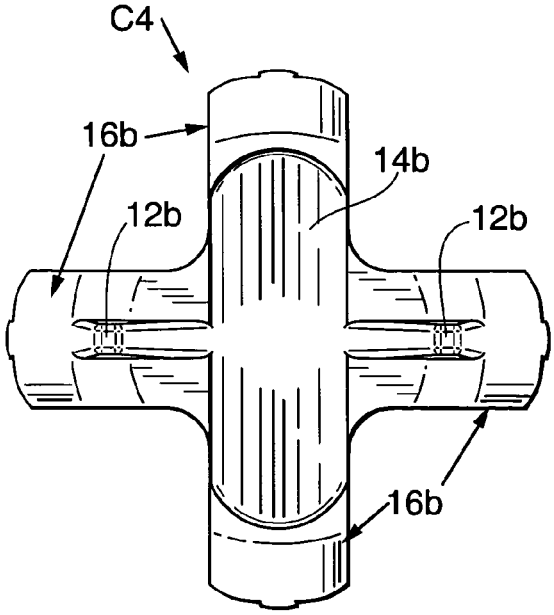
FIG. 19 is a plan view of the fourth embodiment chair.

The cross-shaped table 10*b* has inwardly scalloped edges between the legs 16*b* (see FIG. 18). As compared to the circular tables of the first, second and third embodiments, the scalloped configuration has the advantage that it provides open space between the legs which facilitates extending a tie element beneath the table and over a rebar supported thereon.

CONCLUSION

From the foregoing description and accompanying drawings, it is believed apparent that the present invention enables the attainment of the objects initially set forth herein. In particular, it provides an improved rebar chair and sand plate of a strong and stable construction which is ideally suited for fabrication by injection molding. It should be appreciated, however, that the invention is not intended to be limited to the details of the illustrated embodiments, but rather is defined by the accompanying claims.

We claim:

1. A rebar support chair comprising:

a) a table having diametrically opposed ears extending upwardly therefrom, said ears being adapted to engage a rebar therebetween;

b) elongate legs having proximal ends fixed to the table, said legs extending downwardly from the table at generally equally annularly spaced locations therearound, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the table so that the outer shell defines a segment of a cone;

iii) having a free distal end portion separate from the other legs to provide free access between the legs;

iv) terminating in a foot formed on the web portion to the inside of the outer shell.

2. A support chair according to claim 1 wherein:

a) the table is generally circular; and, b) the ears are located so as to be between the annularly spaced locations from which the legs extend.

3. A support chair according to claim 1 wherein the outer shell of each leg converges adjacent the distal end portion of the leg to provide space proximal to the foot into which fluid concrete formed around the leg may flow.

4. A support chair according to claim 1 wherein the chair is of a unitary construction and formed of a polymeric material, and further comprises a ring integrally formed with and extending between the legs in spaced relationship to the table.

5. A support chair according to claim 4 wherein the ring has arcuate outer surface portions contiguous with the arcuate outer surface portions of the legs to define therewith a smooth conical surface extending around the chair.

6. A support chair according to claim 4, wherein:

a) the ring has an upper edge disposed in spaced relationship to the table and a lower edge disposed in spaced relationship to the distal ends of the legs; and, b) the ring is tapered to reduce in cross-section from the lower edge to the upper edge.

7. A support chair according to claim 4, wherein:

a) the ring has an upper edge disposed in spaced relationship to the table and a lower edge disposed in spaced relationship the distal ends of the legs; and, b) the lower edge is arched between each adjacent pair of legs to provide and increased area of merger between the ring and the legs.

8. A support chair according to claim 1 wherein:

a) the chair is of a unitary construction and formed of a polymeric material; and, b) the web portion is tapered to reduce in depth toward the distal end portion of the leg.

9. A support chair according to claim 1 wherein:

a) the chair is of a unitary construction and formed of a polymeric material; and, b) the web portions of the respective legs are joined with each other to define a bridge integrally formed with and extending across and beneath the table.

10. A support chair according to claim 1 wherein:

a) the chair is of a unitary construction and formed of a polymeric material;

b) the legs are disposed in pairs on diametrically opposite sides of the table; and, c) the web portions of the paired diametrically opposed legs extend inwardly and are joined to provide a bridge beneath and integrally formed with the table.

11. A support chair according to claim 1 wherein the chair is of a unitary construction and formed of a polymeric material, and further comprises:

a) a flexible strap integrally formed as part as a part of the chair, said strap having a proximal portion secured to the chair, an intermediate portion disposed for select extension over the table, and a free distal portion; and, b) means to selectively secure the distal portion to the chair with the intermediate portion extending over the table.

12. A support chair according to claim 11 wherein:

a) the proximal portion is secured to the chair so that the strap is extendable over the table in alignment with the ears; and, b) the means to secure the strap is disposed to hold the strap in such alignment.

13. A support chair according to claim 11 wherein the means comprises interengageable mating elements on the chair and strap.

14. A support chair according to claim 13 wherein said interengageable mating elements comprise a protrusion formed on the chair and an opening formed in the strap for engagement over the protrusion.

15. A support chair according to claim 1 wherein:

a) the leg is of an elongate configuration extending from the table to the distal end; and, b) the inwardly extending web tapers from either end of the leg to a portion of increased depth intermediate the ends of the leg.

16. A support chair according to claim 1 wherein:

a) the table has a generally horizontal top surface; and, b) the legs diverge outwardly from the table at an angle of from ninety four to one hundred and eleven degrees from the top surface.

17. A support chair, according to claim 1, wherein:

a) the table is unitary and comprises intersecting elements defining a cross-shaped configuration, as viewed in plan; and, b) the legs are integrally formed with and extend downwardly from oppositely disposed ends of the elements.

18. A support chair according to claim 17 wherein the ears are integrally formed with and extend upwardly from the oppositely disposed ends of one of the elements.

19. A support chair according to claim 17, wherein:

a) the chair is of a unitary construction and formed of a polymeric material; and b) the web portions for the legs are integrally formed with and join beneath the elements.

20. A support chair according to claim 19 further comprising reinforcing webs extending between the web portions, said webs being integrally formed with and disposed beneath said elements.

21. A rebar support chair comprising:

a) a table having diametrically opposed ears extending upwardly therefrom said ears being adapted to engage a rebar therebetween;

b) elongate legs fixed to and extending downwardly from the table at generally equally annularly spaced locations therearound, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the table so that the outer shell defines a segment of a cone;

iii) terminating at a distal end formed on the web portion to the inside of the outer shell;

c) a foot formed on the web portion at the distal end of each leg, wherein the foot includes traction means in the form of an irregular surface formed on the inwardly extending web portion at the distal end of the leg.

22. A support chair according to claim 21 wherein the irregular surface is defined by serrations extending transversly of the web portion.

23. A rebar support chair comprising:

a) a table having diametrically opposed ears extending upwardly therefrom, said ears being adapted to engage a rebar therebetween;

b) elongate legs fixed to and extending downwardly from the table at generally equally annularly spaced locations therearound, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the table so that the outer shell defines a segment of a cone;

iii) terminating at a distal end formed on the web portion to the inside of the outer surface portion;

c) a foot formed on the web portion at the distal end of each leg;

d) a bearing member for securement to the distal ends of the legs to support the legs on soft soil and against uneven penetration into the soil, said member comprising:

i) a plate having a planar top surface;

ii) slots formed in and extending through said plate, said slots being aligned with and receiving the distal ends of the legs and having opposed side surfaces in snug engagement with opposite side surfaces of the distal ends.

24. A rebar support chair comprising:

a) a cradle for supporting engagement with a rebar;

b) elongate legs having proximal ends fixed relative to the cradle, said legs extending downwardly from the cradle at annularly spaced locations, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the cradle so that the outer shell defines a segment of a cone;

iii) having a free distal end portion separate from the other legs to provide free access between the legs; and, iv) terminating in a foot formed on the web portion to the inside of the outer shell.

25. A support chair according to claim 24 wherein the outer shell of each leg converges adjacent the distal end portion of the leg to provide space proximal to the foot into which fluid concrete formed around the leg may flow.

26. A support chair according to claim 24 wherein the chair is of a unitary construction and formed of a polymeric material, and further comprises a ring integrally formed with and extending between the legs in spaced relationship to the cradle.

27. A support chair according to claim 26 wherein the ring has arcuate outer surface portions contiguous with the arcuate outer surface portions of the legs to define therewith a smooth conical surface extending around the chair.

28. A support chair according to claim 26, wherein:

a) the ring has an upper edge disposed in spaced relationship to the cradle and a lower edge disposed in spaced relationship to the distal ends of the legs; and, b) the ring is tapered to reduce in cross-section from the lower edge to the upper edge.

29. A support chair according to claim 26, wherein:

a) the ring has an upper edge disposed in spaced relationship to the cradle and a lower edge disposed in spaced relationship to the distal ends of the legs; and, b) the lower edge is arched between each adjacent pair of legs to provide and increased area of merger between the ring and the legs.

30. A support chair according to claim 24 wherein:

a) the chair is of a unitary construction and formed of a polymeric material; and, b) the web portion is tapered to reduce in depth toward the distal end portion of the leg.

31. A support chair according to claim 24 wherein the chair is of a unitary construction and formed of a polymeric material, and further comprises:

a) a flexible strap integrally formed as part as a part of the chair, said strap having an proximal portion secured to the chair, an intermediate portion disposed for select extension over the cradle, and a free distal portion; and, b) means to selectively secure the distal portion to the chair with the intermediate portion extending over the cradle.

32. A support chair according to claim 31 wherein the means comprises interengageable mating elements on the chair and strap.

33. A support chair according to claim 32 wherein said interengageable mating elements comprise a protrusion formed on the chair and an opening formed in the strap for engagement over the protrusion.

34. A support chair according to claim 24 wherein:

a) the leg is of an elongate configuration extending from the table to the distal end; and, b) the inwardly extending web tapers from either end of the leg to a portion of increased depth intermediate the ends of the leg.

35. A support chair according to claim 24 wherein:

a) the cradle has a generally horizontal top surface for supporting engagement with a rebar; and, b) the legs diverge outwardly from the cradle at an angle of from ninety four to one hundred and eleven degrees from the top surface.

36. A rebar support chair comprising:

a) a cradle for supporting engagement with a rebar;

b) elongate legs fixed relative to and extending downwardly from the cradle at annularly spaced locations, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the cradle so that the outer shell defines a segment of a cone;

iii) terminating at a distal end formed on the web portion to the inside of the outer shell;

c) a foot formed on the web portion at the distal end of each leg, wherein the foot includes traction means in the form of an irregular surface formed on the inwardly extending web portion at the distal end of the leg.

37. A support chair according to claim 36 wherein the irregular surface is defined by serrations extending transversly of the web portion.

38. A rebar support chair comprising:

a) a cradle for supporting engagement with a rebar;

b) elongate legs fixed relative to and extending downwardly from the cradle at annularly spaced locations, each said leg:

i) being of a unitary generally T-shaped cross-section with a single thickness arcuate outer shell and an inwardly disposed reinforcing web portion extending over substantially the entire length of the outer shell, the outer shell and the web portion having substantially the same length;

ii) diverging outwardly from the cradle so that the outer shell defines a segment of a cone;

iii) terminating at a distal end formed on the web portion to the inside of the shell;

c) a foot formed on the web portion at the distal end of each leg;

d) a bearing member for securement to the distal ends of the legs to support the legs on soft soil and against uneven penetration into the soil, said member comprising:

i) a plate having a planar top surface;

ii) slots formed in and extending through said plate, said slots being aligned with and receiving the distal ends of the legs and having opposed side surfaces in snug engagement with opposite side surfaces of the distal ends.

* * * * *